US005832936A

United States Patent [19]

Pruchnic et al.

[11] Patent Number: 5,832,936

[45] Date of Patent: Nov. 10, 1998

[54] GRADUATED ARTIFICIAL NAIL TIPS AND THE METHOD OF APPLYING SAME

[75] Inventors: Sandra A. Pruchnic; Bruce A. Pruchnic, both of North Las Vegas, Nev.

[73] Assignee: S & B Nail Technology, Inc., North Las Vegas, Nev.

[21] Appl. No.: 966,097

[22] Filed: Nov. 7, 1997

[51] Int. Cl.[6] ..... A45D 29/00

[52] U.S. Cl. ..... 132/73; 132/285; 132/200; 132/73.5

[58] Field of Search ..... 132/73, 285, 200, 132/73.5

[56] References Cited

U.S. PATENT DOCUMENTS

| | | | |
|---|---|---|---|
| 3,993,084 | 11/1976 | Cullen | 132/73 |
| 4,779,632 | 10/1988 | Howa | 132/73 |
| 5,070,892 | 12/1991 | Trematerra | 132/73 |
| 5,127,414 | 7/1992 | Mast et al. | 132/73 |
| 5,372,150 | 12/1994 | Hughes . | |
| 5,513,664 | 5/1996 | Krupsky | 132/73 |

FOREIGN PATENT DOCUMENTS 2606611 5/1998 France .

*Primary Examiner*—Gene Mancene
*Assistant Examiner*—Pedro Philogene
*Attorney, Agent, or Firm*—Harry M. Weiss; Jeffrey D. Moy; Harry M. Weiss & Associates, P.C.

[57] ABSTRACT

Graduated artificial fingernail tips for creating longer fingernails includes an artificial fingernail tip and length-indiciating indicia on an upper surface of the tip. The length-indicating indicia may be numbers or letters corresponding to graduated trim points. A method for applying the graduated artificial fingernail tips is also provided which includes buffing out the indicia after conventional adhesion of the tip to the natural nails. The graduated tips and method enable a quick and easy application of the tips to create a manicure with nails of substantially uniform length.

11 Claims, 1 Drawing Sheet

GRADUATED ARTIFICIAL NAIL TIPS AND THE METHOD OF APPLYING SAME

FIELD OF THE INVENTION

This invention relates generally to nail products for creating long fingernails. More specifically, this invention relates to artificial nail tips with graduated trim points for matching fingernail lengths to achieve a well-manicured set of fingernails.

BACKGROUND OF THE INVENTION

The nail industry has developed artificial nails for those people unable or unwilling to grow and maintain their own natural nails. Some people prefer sculptured nails while others prefer artificial tips which can be made of plastic, nylon or acetate. Tips are adhered to the natural nail to add extra length. They usually are combined with another artificial service, such as a fabric wrap, gel, or acrylic, since a tip worn without an overlay is weak.

The artificial tips generally are available in a variety of sizes for variations in individuals but also for differences in finger size, for example, between a thumb and other finger. The nail tip should completely cover the natural nail plate from sidewall to sidewall but not more than half the length of the nail. All artificial nail tips have a well that serves as the point of contact with the natural nail plate. Tips are designed with either a partial well or full well, the partial well being adhered closer to the natural nail tip than a tip with a full well. A position stop is the point where the nail plate meets the artificial tip before it is glued to the natural nail plate with nail adhesive. The position stop is defined as a ridge in a lower surface of the artificial tip.

Artificial tips are available in a variety of lengths. A manicurist is able to choose from a selection of artificial tips sold under such catchwords as "active length", "glamour length", or "career length" etc. After choosing the general length desired, the tips are secured on the nail plate by adhesive and then filed to smooth any ridges. Polish is then usually applied. So-called "versatile" artificial tips are also available which are of extraordinary length designed to be trimmed down and filed to the length desired. The professional manicurist generally uses this type because of such versatility since he or she does not have to keep so many artificial tips of different lengths on hand.

Unfortunately, the application of versatile artificial tips is extremely time-consuming and inexact. More particularly, to insure proper alignment of the nail tip, the natural nails are first filed to substantially the same length before adhering the artificial tip at the position stop. Once adhesive is placed on the nail plate to cover the area where the tip will be placed, the artificial tips are slid onto the natural nail plate at a 45 degree angle until the tip hits the position stop. A bead of adhesive is further applied to the seam between the natural nail plate and the artificial tip to strengthen this stress point. The manicurist must cut the tips to an approximate length and then file the tips extensively to the desired length and shape, generally oval or squared-off. This process involves continuous eyeballing comparisons and measurements of the other fingers to achieve a uniform length set of fingernails. This requires a lot of filing and guesswork and thus a lot of time.

Moreover, the inability to predetermine length can be confusing to a manicurist's client. Although hand mannequins are helpful in this regard, there is usually not enough disparity in nail length and no guidelines to help the client make a decision. The client must simply indicate that his or her desired nail length approximates that shown on the mannequin.

Accordingly, there has been a need for novel artificial fingernail tips which are easy and rapid to apply. Such tips are needed which save time by minimizing filing and which take the guesswork out of matching fingernail length. Additionally, the fingernail length is reproducible from one appointment to the next. Further, the tips are needed for helping to create a well-manicured set of fingernails of substantially uniform length. The present invention fulfills these needs and provides other related advantages.

SUMMARY OF THE INVENTION

The present invention resides in graduated artificial fingernail tips for adhering to natural nails, which are easy and rapid to apply, which minimize filing, and which create a well-manicured hand with a set of substantially uniform length fingernails that can be reproduced easily from one appointment to the next. The graduated artificial fingernail tip comprises, generally, an artificial nail for adhering to a natural nail and indicia on the artificial nail corresponding to graduations in length.

The artificial fingernail may be an artificial fingernail tip, with either a partial or full well. The tip has a first and second end. The first end is oriented closest to the natural nail cuticle, although not more than over half the natural nail. The opposite second end extends beyond the fingertip. The tip also has a lower surface having a position stop, the lower surface adhered with nail adhesive to the natural nail plate and an upper surface where polish is ultimately conventionally applied.

The indicia include a plurality of sequential numbers and associated lines raised above the upper surface of the artificial fingernail tip. The indicia begin near the first end of the tip and ending substantially at the tip of the second end. The numbers and associated lines correspond to graduated trim points from the shortest length to the longest length. The graduations are in standard increments, for example, ⅛ inch, starting from the position stop. The indicia may also be letters or other length-indicating indicia.

In the method of the invention, the tips are adhered to the natural nail plate in a conventional manner. The tips are then trimmed to a desired and substantially uniform length by cutting the tips at the same number and on the associated line of each of the tips. The same number on each of the artificial tips, notwithstanding the differences in tip size i.e. width, represents substantially the same tip length as measured from position stop to the trim point of the artificial tip. The numbers and associated lines are then removed by using a buffer block. The fingernails are shaped and polish may be applied as in the conventional manner.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
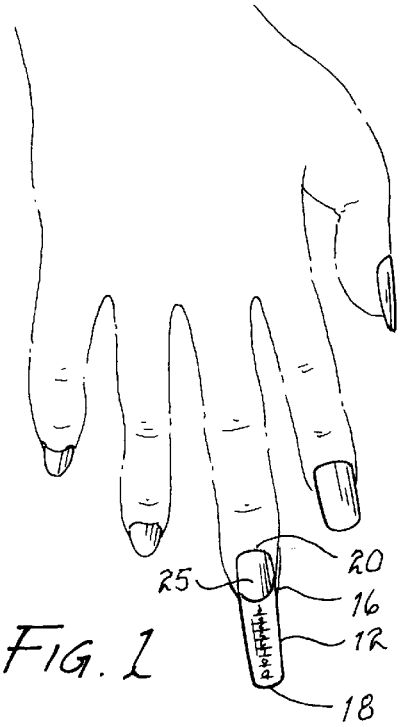
FIG. 1 is a perspective environmental view of a graduated artificial nail tip having a partial well embodying the invention, illustrating the tip as adhered to a natural fingernail.

As shown in the drawings for purposes of illustration, the present invention is concerned with graduated artificial nail tips, generally designated in the accompanying drawings by the reference number 10. The present invention is also concerned with a method of applying the graduated artificial nail tips. The graduated artificial nail tips comprise, generally, an artificial nail tip 12 and length indicating indicia 14 on the tip corresponding to graduated trim points.

The artificial nail tip 12 generally has a first end 16 and a second end 18. The first end 16 is oriented closest to the natural nail cuticle 20 and the second end 18 usually extends beyond the fingertip 22. The first end 16 may be either a full well (not shown) or partial well 24. The well serves as a point of contact with a nail plate 25. The first end 16 of a full well tip is convexly shaped to cover approximately one-half the natural nail plate 25 while the first end of a partial well tip is concavely shaped and used closer to the natural fingernail tip. The second end 18 generally extends beyond the fingertip.

The artificial nail tip 12 also has an upper 26 and lower surface (not shown). The upper surface 26 is where polish is conventionally applied. The lower surface is the underside of the tip which is adhered to the natural nail plate by nail adhesive. The lower surface includes a position stop (not shown) defined by a ridge. The position stop is the point where the nail plate 25 meets the tip 12 before it is adhered to the nail plate 25.

Figure 2:
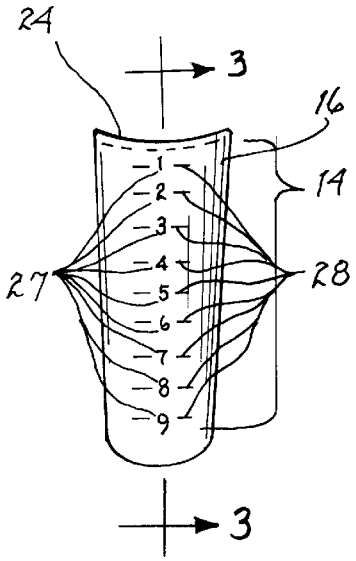
FIG. 2 is an enlarged top view of the artificial nail tip of FIG. 1, illustrating a sequential arrangement of numbers and associated lines corresponding to graduated trim points.
Figure 3:
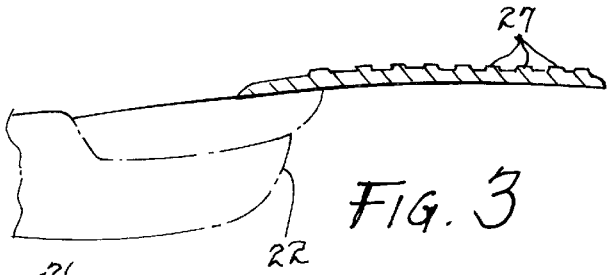
FIG. 3 is a perspective side view of the artificial nail tip of FIG. 1 taken generally along the line 3—3 of FIG. 2, illustrating that the numbers are raised above an upper surface of the artificial nail tip.

The length indicating indicia 14 are a sequential arrangement of numbers 27 from "1" through "9" and associated lines 28 that correspond to ⅛ inch graduations in trim points as illustrated in FIG. 2. The graduations are measured from the position stop of each tip. The number "1" corresponds to the shortest length while the number "9" corresponds to the longest length. The indicia are impressions from the tip molding process and are raised above the tip upper surface 26 as illustrated in FIG. 3. Although the numbers 1–9 serve as the length indicating indicia 14 in the preferred embodiment, it is to be appreciated that other numbers or other length indicating indicia may be used, for example, an arrangement of letters. Similarly, the graduations may be in something other than ⅛ inch increments and in a different order, for example, where the largest number represents the shortest trim point. Moreover, the numbers may be formed by other than a molding process such as by a printing process, etc.

Figure 4:
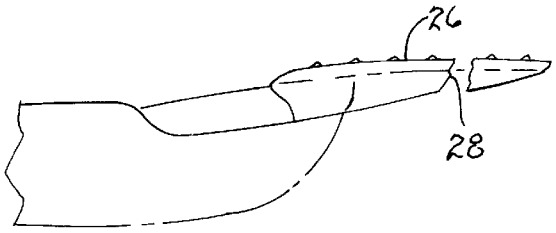
FIG. 4 is a fragmented perspective side view of the artificial nail tip of FIG. 1, illustrating the manner in which the tip is trimmed at a selected trim point.
Figure 5:
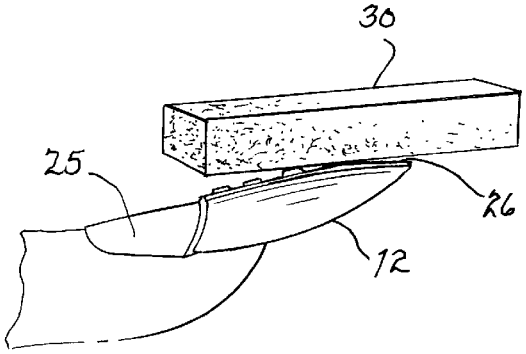
FIG. 5 is a further perspective view similar to FIG. 4, illustrating the manner in which the numbers are removed by a buffer block.

In the method of the invention, the lower surface (not shown) of the artificial nail tip 12 is adhered to the natural nail plate 25 in the conventional manner. As illustrated in FIG. 4, the tip 12 is cut on the line 28 at the desired trim point by choosing the number 27 corresponding to the desired length. This step is repeated for each nail until the fingernails on each hand are complete and of substantially uniform length, each nail on the same hand being cut at the same number and thus at the same trim point. The tip 12 is then minimally filed or buffed with a buffer block 30 to smooth any rough edges and remove the raised indicia as illustrated in FIG. 5. An overlay is usually then applied to strengthen the nail. As with conventional tips, polish is then applied to the upper surface of the fingernail or overlay including the artificial tip 12.

From the foregoing it is to be appreciated that the graduated artificial fingernail tips 12 and method of the invention saves the manicurist a great deal of time by minimizing filing and removes the guesswork involved in matching fingernail lengths. By choosing the same number corresponding to the desired length for every finger, the manicurist is able to consistently, quickly and easily create a substantially uniform set of fingernails. This uniformity can be reproduced from one manicure to the next which also helps the client since they can know in advance how that length will look.

Although a particular embodiment of the invention has been described in detail for purposes of illustration, various modifications may be made without departing from the spirit and scope of the invention. Accordingly, the invention is not to be limited, except as by the appended claims.

We claim:

1. A graduated artificial fingernail, comprising:

a substantially hard artificial fingernail for adhering to and extending beyond a natural fingernail; and indicia on said artificial fingernail corresponding to graduations in length.

2. The graduated artificial fingernail of claim 1, wherein the artificial fingernail comprises an artificial fingernail tip.

3. The graduated artificial fingernail of claim 2, wherein the length indicating indicia include a plurality of numbers and associated lines raised above an upper surface of the artificial fingernail tip.

4. The graduated artificial fingernail of claim 3, wherein the numbers include sequential numbers.

5. The graduated artificial fingernail of claim 2, wherein the length indiciating indicia include a plurality of letters raised above an upper surface of the nail tip.

6. The graduated artificial fingernail of claim 2, wherein the length indicating indicia correspond to ⅛ inch graduations in length.

7. A graduated artificial fingernail tip, comprising:

an artificial nail tip;

a sequential arrangement of raised numbers and associated lines above an upper surface of the tip, the numbers corresponding to sequential trim points and spaced in ⅛ inch graduations.

8. A method of applying graduated artificial fingernail tips to create longer fingernails than the natural nails, comprising:

Adhering at least one of the graduated artificial nail tips to at least one of the natural nails;

Trimming each of the tips to a trim point represented by the same indicia selected from an arrangement of indicia on an upper surface of the tips which correspond to graduated trim points;

Removing the indicia; and

Shaping and polishing the fingernails.

9. The method of claim 8, wherein the indicia include indicia on a raised surface over an upper surface of the natural nail.

10. The method of claim 8, wherein removing the indicia includes buffing out the indicia with a buffer.

11. The method of claim 8, wherein the indicia includes a sequential arrangement of numbers and associated lines.

* * * * *